US005791078A

United States Patent [19]

Maranto et al.

[11] Patent Number: 5,791,078

[45] Date of Patent: Aug. 11, 1998

[54] LIQUID LENS

[76] Inventors: Frank A. Maranto, 2528 Kendall St.; Ingeborg U. V. Kendall, 2540 Kendall St., both of La Verne, Calif. 91750

[21] Appl. No.: 771,419

[22] Filed: Dec. 20, 1996

[51] Int. Cl.[6] ..... G09F 19/00

[52] U.S. Cl. ..... 40/406; 40/455; 446/267

[58] Field of Search ..... 40/406, 407, 409, 40/455; 52/171.3; 446/267

[56] References Cited

U.S. PATENT DOCUMENTS

| | | | |
|---|---|---|---|
| 1,777,944 | 10/1930 | Trovato . | |
| 3,706,149 | 12/1972 | Olivieri . | |
| 4,208,848 | 6/1980 | Kohl . | |
| 4,240,218 | 12/1980 | Kotzin | 40/407 |
| 4,352,149 | 9/1982 | Stetler . | |
| 4,490,931 | 1/1985 | Fleemin . | |
| 4,591,955 | 5/1986 | Kallay . | |
| 4,923,429 | 5/1990 | Lewis | 40/406 X |
| 4,944,125 | 7/1990 | Ito | 52/171.3 |
| 4,985,811 | 1/1991 | Weiner . | |
| 5,106,660 | 4/1992 | Vorel . | |
| 5,291,674 | 3/1994 | Torrence | 40/410 |
| 5,349,771 | 9/1994 | Burnett . | |
| 5,363,577 | 11/1994 | Fuller et al. . | |
| 5,476,068 | 12/1995 | Townsend | 40/406 X |
| 5,666,750 | 9/1997 | Segan et al. | 40/410 |

*Primary Examiner*—Brian K. Green
*Attorney, Agent, or Firm*—Randy W. Lacasse

[57] ABSTRACT

A display such as an advertisement or selection of art is enhanced by the addition of a random movement bubble device. The bubble device includes a sealed, optically clear cavity containing a clear, slightly viscous fluid, which coacts with a bubble wand assembly to produce eye-catching random bubble configurations. Lighting and/or sound can be added to the bubble device to further attract a viewer's attention to the display and ultimately the product advertisement, etc.

13 Claims, 3 Drawing Sheets

LIQUID LENS

BACKGROUND OF THE INVENTION

1. Field of Invention

This invention relates in 'general'to decorative displays that incorporate the principles of movement. More specifically, the present invention incorporates the movement of bubbles through a liquid producing a random motion which attracts an observer's attention to a display.

The design of decorative displays often incorporate the principles that attract the human eye so that the display will be observed. Often times color, movement, light or a combination thereof are used to attract an observer's attention. Random movement particularly attracts the eye. Typically, displays incorporate scenic or attractive logos or product oriented material of various types mounted behind transparent panes. These displays are often freestanding or integrated into a product dispenser, such that the display will attract the attention of the human eye, display a perceived need for the product, and then provide a means to obtain the product, e.g. vending machine, phone numbers, etc.

The present invention uses a novel combination of the above principles to provide a decorative eye-catching display cover, termed "liquid lens", for a variety of existing displays and for an integrated solution to new designs of attractive displays.

2. Discussion of Prior Art

In order to provide background information so that the invention may be completely understood and appreciated in its proper context, reference may be made to a number of prior art patents as follows:

U.S. Pat. No. 5,106,660 to Vorel describes decorative wall panels that employ a panel containing a liquid and use the random movement of bubbles to attract the eye. The bubbles flow from a diffuser bottom of the panel to the top through a liquid creating the random eye catching movement. This patent also employs "edge lighting" to enhance the attractive effect. However, the structure is free standing, incorporated into a partition section, or wall hanging unit or window, and is not employed inside a frame for the use of integration into existing or new displays. Failure to provide this structure disconnects the viewer with the existing display or scenic picture or logo behind the invention's frame.

U.S. Pat. No. 1,777,944 to Trovato combined an aquarium with a picture wherein the container for the fish is set in association with scenery framed to give the effect of a picture, the scene being congruent with a body of water. Lighting is also used to render the aquarium beautiful in appearance. This patent lacks the use of randomly generated bubbles flowing from the bottom to the top of the display to attract the viewer's eye.

U.S. Pat. No. 5,349,771 to Burnett includes a rising bubble display device with a lamp positioned beneath the reservoir. The invention improves the service and manufacture of rising bubble displays, but fails to disclose using the display as a frame to attract the viewer to a display or logo directly behind the rising bubble water panel display.

U.S. Pat. No. 5,363,577 to Fuller et al. describes a water display using bubbles that can display graphic symbols, such as letters and words. This invention creates a plurality of bubbles that combine to form a visual image, such as a word or company logo. This art fails to associate its visual effect of bubbles and symbols with another visual display residing behind the display device.

U.S. Pat. No. 3,706,149 to Olivieri provides for a display device for producing a constantly changing visual effect on a completely random and unpredictable basis. Air is diffused and bubbled through a plurality of fluid chambers. Each fluid chamber is provided with a viscous fluid of different color, enclosed by transparent walls, and illuminated by a light source from one side of the display device. This art fails to associate its visual effect with another visual display residing behind the display device.

Whatever the precise merits, features, and advantages of the above cited references, none of them achieve or fulfills the purposes of the liquid lens display device of the present invention.

Accordingly, it is a principal object of the present invention to provide a decorative display cover of scenic transparency, providing a randomly-generated, attention-grabbing, attractive appeal. Initially the attention-grabbing appeal will allow for the observer's visual attention to be attracted to the display of the present invention and thereafter transferred to the visual display residing directly behind the present invention.

It is another principal object of the present invention to provide a randomly-generated air bubble and fluid motion display in conjunction with source lighting to provide the above noted initial attention-grabbing attractive appeal.

It is another principal object of the present invention to allow for a large variety of sizes and shapes for the attachment in front of current and future manufactured visual displays, product dispensers, and point of sale devices.

It is another principal object of the present invention to allow for a variety of alternative construction materials meeting the general functional specifications provided herein.

SUMMARY OF THE INVENTION

The liquid lens decorative display device of the present invention provides a novel combination of eye-catching, random bubble movement and lighting visual effects and sound to attract the observer's attention and then enable that attention to be centered on a product logo, advertisement, product, or scene displayed directly behind the liquid lens display. In a preferred embodiment, a single fluid compartment is comprised of two optically clear transparent panels mated with a plastic thin "donut" or central frame, thereby creating a chamber for a clear, non-toxic, non-combustible, slightly viscous fluid that is resistant to foaming and evaporation. The side strip or "donut" is sealed to the front and back transparent panels, providing a leak-proof seal for the enclosed fluid. Air inlet tubing, connected to a central air pump, supplies air to a perforated "bubble wand", bubble-producing cylinder, attached to the bottom of the fluid chamber. The panels of the fluid compartment are spaced sufficiently apart, varying with the display size, in order to achieve optimal bubble size, reflection and movement. Back lighting and sound modules may be added to further attract the viewer's attention to the display and ultimately the product logo, advertisement, product, or scene displayed directly behind the liquid lens display.

DESCRIPTION OF THE PREFERRED EMBODIMENTS

Figure 1:
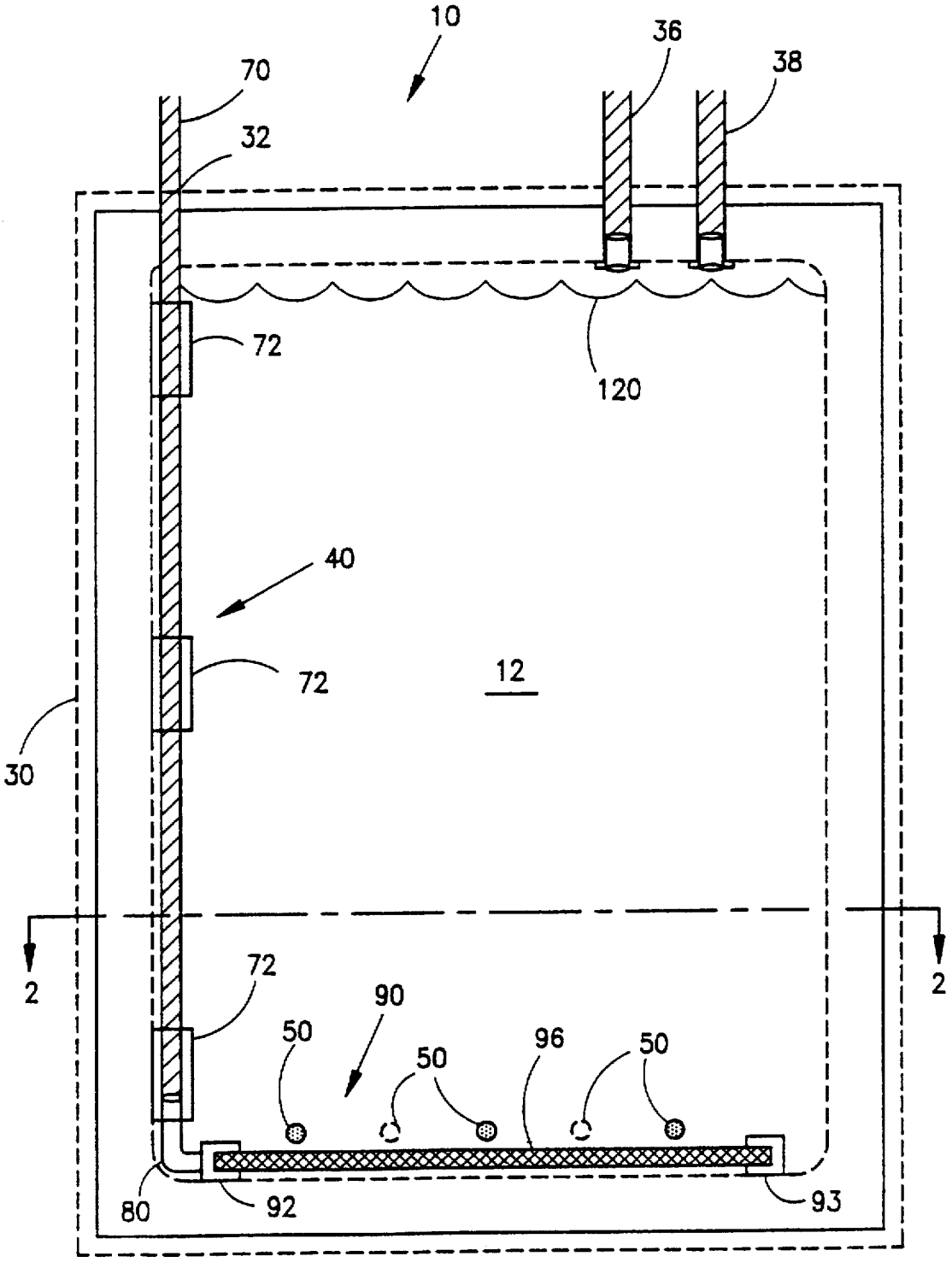
FIG. 1 is a perspective view of the liquid lens display constructed in accordance with the preferred embodiment of this invention.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications of the materials for its construction and is not intended to limit the invention to the embodiment illustrated. Those skilled in the art will envision many other possible variations within the scope of the present invention. For example, the shapes and dimensions of the various embodiments may be altered. Also alternative materials may be used to construct the "liquid lens" panels, supports, air inlet tubing, or "bubble wand" assembly, or the fluid contained therein. These and other variations may be made while remaining within the scope of the invention.

FIG. 1 illustrates the "liquid lens" decorative display in its entirety as 10, and is comprised of a front transparent panel 12 and a back transparent panel 20 (FIG. 2), and a "donut" spacer 30, cut from one approximate 0.477 inch clear cast acrylic sheet. The front transparent panel 12 and back transparent panel 20 have sufficient light transmissibility to be optically clear. The entire "liquid lens" display 10 is preferably a transparent, cast material, such as acrylic plastic to guarantee sufficient weld strength and stretch resistance. A polycarbonate or abrasion resistant material can be used for additional damage resistance. The interior space, enclosed by the front 12 and back 20 transparent panels, and the exterior "donut" spacer 30, encloses an inlet air supply and "bubble wand" tubing assembly 40, support system and a viscous fluid.

Positioned on one side of the top exterior spacer support is an air inlet hole 32 providing for an exterior connection of a single, contiguous, inlet air supply tubing 70. The inlet air supply tubing connection 70 is cylindrical, flexible, frosty, highly resistant to yellowing, strong and both air and fluid tight. The distal end of the exterior portion of the inlet air supply tubing 70 is subsequently connected to an external air filter, check valve and supply pump (not shown). The external air filter, check valve and supply pump are electrically wired to operate from the same electrical supply as a point-of-sale vending display. Positioned at the right side of the top exterior spacer support are two centered holes, air exhaust 38 and fluid fill 36. Two holes 36, 38 are utilized so that while one is being used as a fluid fill hole the other hole will operate as the air exhaust port, allowing for an efficient and rapid fluid fill operation. One transport fill plug (not shown) is inserted into fluid fill hole 36 while the "liquid lens" display is being filled and subsequently is sealed for proper operation of the unit. The second hole 38 has an air supply tubing connection to a small plastic bottle to catch any spillover of fluid while the unit is in operation and thus avoiding leakage and as a result providing additional safety.

Figure 3:
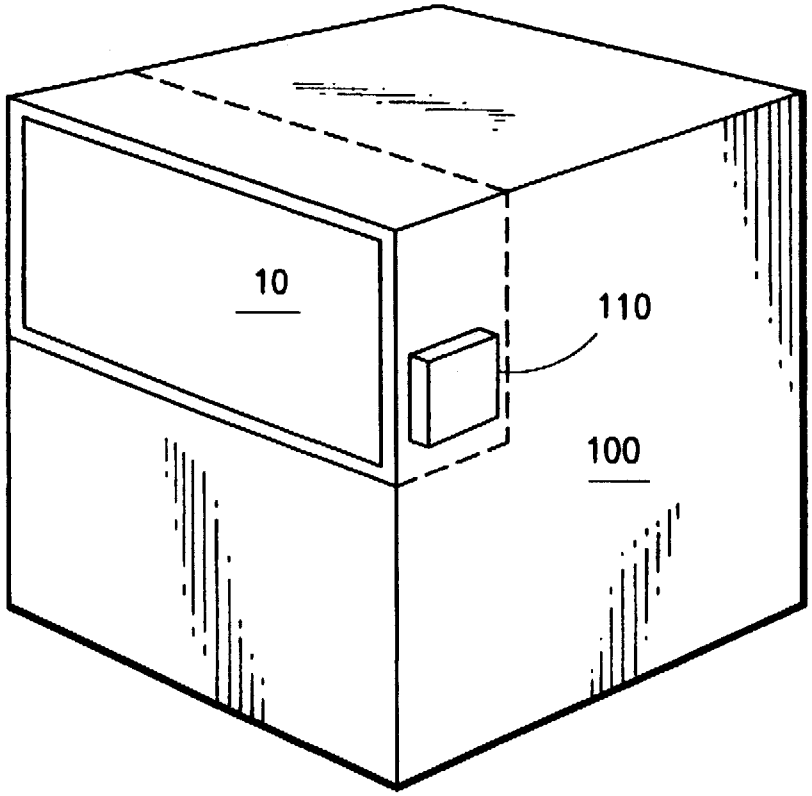
FIG. 3 illustrates a point-of-sale terminal with the present invention incorporated therein.

The preferred embodiment of the invention FIG. 3 has the "liquid lens" decorative display 10 attached directly in front of a point-of-sale 100, back-lit vending display, such that the rear transparent panel 20 faces the vending display and the front transparent panel 12 faces the viewing public. Consequently, the viewing public's eye will be attracted to the random bubbling and reflective light movement.

Once their attention has been attracted to the "liquid lens" decorative display, the point-of-sale vending photographic image 120 display is viewed through the "liquid lens". An additional embodiment, includes the use of a sound module 110 to enhance the viewers attention and further entice them to purchase at the point-of-sale vending machine. For example, the refreshing sound of a carbonated beverage being opened may be played along with the "liquid lens" in front of the image of a cold and frosty beverage as the back-lit beverage display at a point-of-sale, carbonated beverage machine. Another embodiment includes the use of a separate light source with the "liquid lens" decorative display and the point-of-sale vending display not including back lighting.

Figure 2:
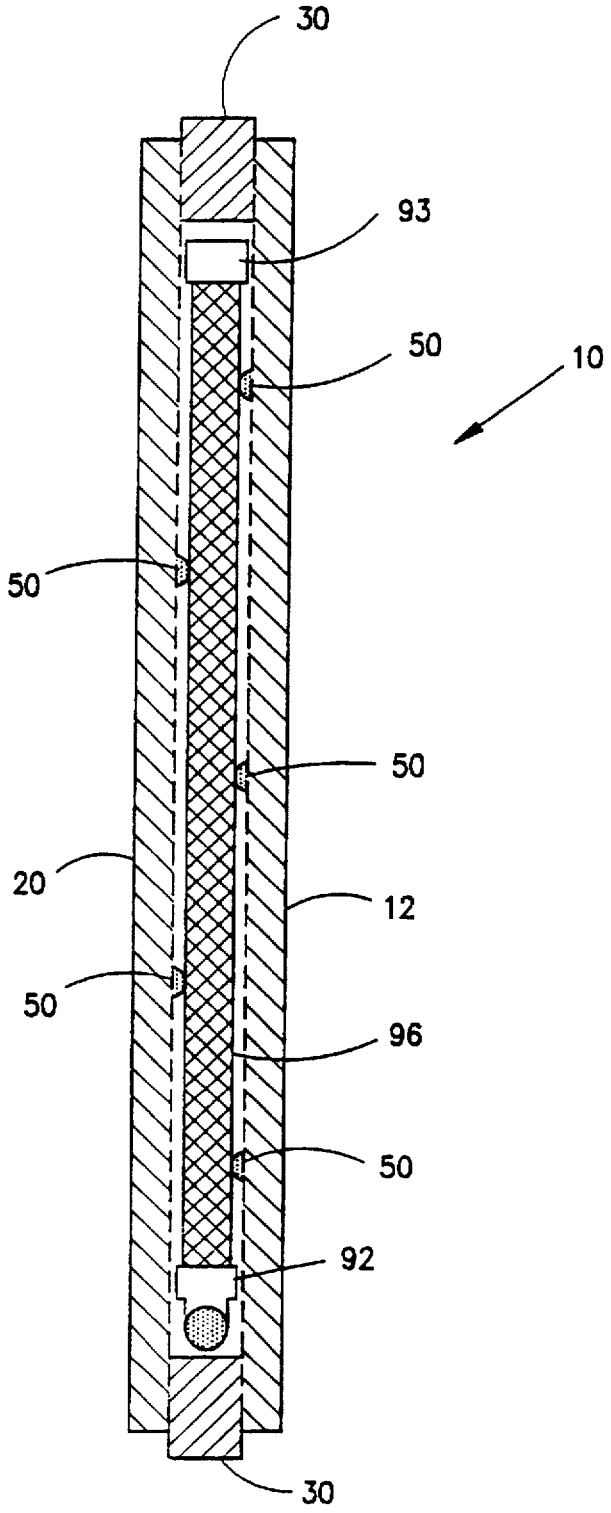
FIG. 2 is an enlarged cross sectional view taken generally along line 2—2 of FIG. 1.
Figure 4:
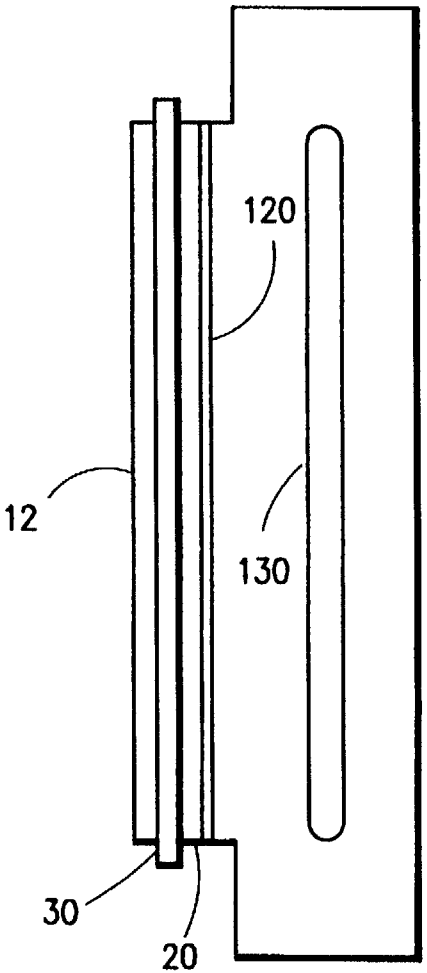
FIG. 4 illustrates a back lighting embodiment of the present invention.

FIG. 2 illustrates the construction of an interior of the "liquid lens" by depicting an enlarged cross sectional view along 2—2 of FIG. 1. The exterior "donut" spacer support 30 0.477 inch in width is positioned and secured with a cement adhesive in a fluid tight relationship to the front and back transparent panels 12 and 20, respectively, thereby increasing the structural strength and provide a large surface area for the cement adhesive thus avoiding fluid leakage.

The cement adhesive is a clear, non-yellowing, fluid corrosion resistant, moderately fast curing solvent adhesive cement of a high weld strength for joining acrylic, such as, methylene chloride tri-chloroethylene and methyl methacrylate monomer, like Weld-On #4 solvent adhesive cement manufactured by IPS Corporation, Gardena, Calif., or equivalents thereof. The cement adhesive must provide for both an air and fluid tight seal for the operational life of the "liquid lens" display.

The single piece, air inlet tube assembly 70 enters through the top inlet air supply hole 32 and extends to the 90-degree connector elbow 80 at the other end. The single piece air inlet tube assembly 70 is supported by air inlet support tubing 72 spaced intermittently (three shown here) along the full interior length and are secured to the right side of the spacer "donut" 30.

A 90-degree single-piece connector elbow 80 is connected between the interior distal end of the air inlet tube assembly 70 and the "bubble wand" section 96. The "bubble wand" assembly 90 includes end caps 92 and 93 and is held in spaced confinement by ⅜ inch diameter hemisperical sections 50.

The "bubble wand" section 96 is perforated with holes at a diameter to produce optimal, yet random, bubble sizes, reflection and movement required to match the point-of-sale vending display size or to which it is attached.

The fluid mixture 120 is a clear, inert, contaminant free, non-toxic, non-combustible mixture, slightly viscous and yet not prone to foaming or evaporation, such as a base fluid of Polypropylene Glycol P-2000 with necessary additives Surfynol 504 surfactant and Surfynol DF-75 defoamer available from Dow Chemical, or the like. The fluid mixture 120 provides the base medium for the random movement of the bubbles, generated from the "bubble wand" assembly 90, as they rise slowly upwards to the top of the "liquid lens" and the air is exhausted out the air exhaust hole 38. The combination of the display size, distance between front 12 and rear 20 transparent panels, perforated hole size of "bubble wand" assembly 96, and fluid mixture 120 viscosity determine the bubble size and movement of the air bubbles.

The ambient air is initially filtered by the external air filter, check valve and pump (not shown), and pumped through the external portion of the inlet air supply tubing 70. The air filter portion of the external air filter, check valve and pump filters the air entering the liquid lens to eliminate fluid contamination. The check valve portion of the external air filter prevents the reverse flow of fluid into the pump.

The pump portion provides the pumping action for the filter air to travel through the inlet air supply and "bubble wand" assembly of the liquid lens. The pump should be rated for continuous duty at 2.4 psi air pressure or better, and provide for extremely quiet operation. The air travels through the tubing in an air tight connection through the top exterior inlet air supply hole 32 and continues to travel through the interior air inlet tube section 70. The interior air inlet tube section 70 is connected to the "bubble wand" assembly 90 by the air-tight, 90-degree elbow connector block 80. The bubbles exit through holes in the perforated "bubble wand" assembly 96 and float to the top of the fluid mixture 120. The air then exits the fluid into the small area between the top level of the fluid 120 and the interior of support 30 and exits through the top interior and exterior air exhaust 38 connected to a small plastic bottle (not shown) that has a small hole along its side at the top, allowing the air to escape while retaining any fluid. This air pumping action system provides for the random bubbling movement for an attractive, eye grabbing appeal of the present invention.

An alternate embodiment, to insure a strong leak proof container, would ultimately be a one-piece molded "liquid lens" container to avoid seams altogether.

Another alternate embodiment of the present invention is as a structural element in an architectural or interior design setting where the decorative attention of the "liquid lens" itself or in combination with an image, such as a photograph printed on plastic film, attached to the back transparent panel 20 and/or sound and lighting effects has the desired effect of attention getting. This alternate embodiment can thus be in-the-wall mounted, hung or a free standing unit.

Another alternate embodiment of the present invention is used when the point-of-sale vending display does not have back lighting. In this case, the front of the point-of-sale vending display image 120 will be placed next to the back transparent panel 20 and a highly illuminated light source 130 will be placed behind both of these displays providing the desired optical effect. Point-of-sale vending displays that are manufactured, incorporating the "liquid lens" display, will be configured in this manner.

CONCLUSION

A system and method has been shown in the above embodiments for the effective implementation of a liquid lens. While various preferred embodiments have been shown and described, it will be understood that there is no intent to limit the invention by such disclosure, but rather, it is intended to cover all modifications and alternate constructions falling within the spirit and scope of the invention as defined in the appended claims.

We claim:

1. A random movement, liquid-animation, decorative display enhancing system comprising:

a pair of substantially parallel optically clear panels having an inner and outer surface;

an inlet air supply tube supplying air;

a bubble wand assembly for the generation of air bubbles, said bubble wand assembly receiving said air;

a one-piece frame section secured between said pair of substantially parallel optically clear panels to form a leak-proof cavity;

a decorative display operatively connected and in visual alignment with at least one of said optically clear panels, and wherein a clear, viscous fluid mixture comprising at least Polypropylene Glycol, a surfactant and defoamer is contained within said cavity enabling random air bubbling action to enhance an observer's observation of said decorative display.

2. A random movement, liquid animation, decorative display enhancing system as per claim 1, wherein said pair of optically clear panels are secured at an optimal distance of 0.375 to 0.500 inches in order to achieve optimal bubble size, reflection and desired bubble movement for a 16 by 20 inch display image size.

3. A random movements liquid animation, decorative display enhancing system as per claim 2, wherein a top section of the one-piece frame section further comprises two drilled holes of + or −0.005 inches.

4. A random movement, liquid animation, decorative display enhancing system as per claim 1, wherein said inlet air supply tube is supported by inlet tube support sections.

5. A random movement, liquid animation, decorative display enhancing system as per claim 1, wherein a single-section 90-degree elbow is used to anchor a distal end of said inlet air supply tube to said one-piece frame section, and connects and seals the inlet air supply tube and a first bubble wand section.

6. A random movement, liquid animation, decorative display enhancing system as per claim 1, wherein said bubble wand assembly is retained by one or more hemispherical sections secured to a lower inside section of at least one of said optically clear panels.

7. A random movement, liquid animation, decorative display enhancing system as per claim 1, wherein said decorative display system comprises a backlight with at least one from the group comprising: point-of-sale, advertisement, or artistic image.

8. A random movement, liquid animation, decorative display enhancing system as per claim 1, wherein said clear, viscous, fluid mixture is not prone to foaming or evaporation and comprises Polypropylene Glycol P-2000 with additives Surfynol 504 surfactant and Surfynol DF-75 defoamer.

9. A random movement, liquid animation, decorative display enhancing system as per claim 1, wherein said decorative display comprises a point-of-sale terminal including a point-of-sale item image.

10. A random movement, liquid animation, decorative display enhancing system as per claim 1, further comprising a sound module.

11. A random movement, liquid animation, decorative display enhancing system as per claim 1, wherein said pair of substantially parallel optically clear panels are acrylic panels.

12. A random movement, liquid animation, decorative display enhancing system as per claim 1, wherein said pair of substantially parallel optically clear panels are damage resistant manufactured with a polycarbonate or abrasion resistant material.

13. A random movement, liquid-animation, decorative display enhancing system comprising:

a pair of substantially parallel optically clear panels having an inner and outer surface;

an inlet air supply tube supplying air;

a bubble wand assembly for the generation of air bubbles, said bubble wand assembly receiving said air;

a one-piece frame section secured between said pair of substantially parallel optically clear panels to form a leak-proof cavity;

a decorative display operatively connected and in visual alignment with at least one of said optically clear panels, and wherein a clear, viscous fluid mixture comprising Polypropylene Glycol P-2000 with additives Surfynol 504 surfactant and Surfynol DF-75 defoamer is contained within said cavity enabling random air bubbling action to enhance an observer's observation of said decorative display.

* * * * *

UNITED STATES PATENT AND TRADEMARK OFFICE

CERTIFICATE OF CORRECTION

PATENT NO. : 5,791,078

DATED : August 11, 1998

INVENTOR(S) : Maranto et al.

It is certified that error appears in the above-identified patent and that said Letters Patent is hereby corrected as shown below:

Column 1, Line 5, after "relates" insert - -, - -.

Column 1, Line 5, before "general" delete [‘].

Column 1, Line 5, after "general" delete [’] and insert therefore - - , - -.

IN THE CLAIMS

Claim 3, line 1, delete [movements] and insert therefore - - movement, - -.

Signed and Sealed this

Twenty-seventh Day of October, 1998

*Attest:*

Bruce Lehman

BRUCE LEHMAN

*Attesting Officer*

*Commissioner of Patents and Trademarks*